US006621765B2

(12) United States Patent
Guhl

(10) Patent No.: US 6,621,765 B2
(45) Date of Patent: Sep. 16, 2003

(54) CLOCK OR WATCH WITH A DEVICE FOR DISPLAYING SYMBOLS

(75) Inventor: Harry Guhl, Basel (CH)

(73) Assignee: Ta Nao Inc., Basel (CH)

( * ) Notice: Subject to any disclaimer, the term of this patent is extended or adjusted under 35 U.S.C. 154(b) by 53 days.

(21) Appl. No.: 10/219,032

(22) Filed: Aug. 14, 2002

(65) Prior Publication Data

US 2002/0196711 A1 Dec. 26, 2002

Related U.S. Application Data

(63) Continuation of application No. PCT/IB01/00194, filed on Feb. 14, 2001.

(30) Foreign Application Priority Data

Feb. 15, 2000 (DE) ..... 200 02 632

(51) Int. Cl.[7] ..... G04B 19/04; G04B 19/06; G04B 25/00

(52) U.S. Cl. ..... 368/80; 368/223

(58) Field of Search ..... 368/21, 22, 27, 368/28, 37, 77, 223, 228, 233, 80

(56) References Cited

U.S. PATENT DOCUMENTS 5,654,940 A * 8/1997 Wei ..... 368/23
6,278,662 B1 * 8/2001 Bruber ..... 368/28

FOREIGN PATENT DOCUMENTS

EP 489652 * 6/1992

* cited by examiner

*Primary Examiner*—Vit Miska
(74) *Attorney, Agent, or Firm*—Sidley Austin Brown & Wood, LLP

(57) ABSTRACT

A watch has a digital or analogue time display and a device for displaying Chinese depictions by means of a display element. The said display element is provided in particular to display the twelve Chinese life symbols (5) and is designed such that it visually reveals one life symbol in each case for a time period of two hours, the respectively visible depiction (5) correlating with a specific time display.

10 Claims, 2 Drawing Sheets

CLOCK OR WATCH WITH A DEVICE FOR DISPLAYING SYMBOLS

RELATED APPLICATION

This application is a continuation of PCT International application No. PCT/IB01/00194 filed Feb. 14, 2001 and designating the United States of America.

BACKGROUND OF THE INVENTION

1. Field of the Invention

The invention relates to a watch having a device for displaying Chinese depictions, which are revealed by a display element.

2. Description of Prior Art

A watch of this type is known from European patent application EP-A 0 489 652. That watch has a display element in the form of a liquid-crystal display, which displays Western astrological symbols and Chinese astrological symbols, all characters being visible at one time and being able to rotate around the display. With this known watch, it is possible to determine eventful hours upon entering a date of birth, an eventful hour being in, each case determined for a Western astrological symbol and an eventful hour likewise being determined for a Chinese symbol. The known device thus assigns a time interval of one hour to a Chinese symbol. The known device is of complex construction and rather too complicated for practical use. It also requires in-depth knowledge of the astrological symbols, since these can be confused with just a fleeting glance. The known display device is also restricted to assigning an astrological ascendant to a specific hour of the day.

The object of the invention is to develop the watch mentioned at the outset or its device for displaying depictions, in such a way that a clear display with new configuration options is created.

SUMMARY OF THE INVENTION

The object of the invention is achieved by providing a display element for displaying Chinese life symbols configured as pictographs or character symbols and which, in each case, visually reveals one life symbol for a time period of two hours or at least suitably marks out the life symbol in the display field of the watch.

Each depiction is visible for a period of two hours, since the inventor has determined an astrological ascendant over two specific hours of a day. This provides an additional new configuration allowing the user of the device according to the invention to make important decisions over two hours in association with a specific Chinese life symbol.

The device according to the invention is integrated in a watch having an analogue or digital time display. In the combination with an analogue wristwatch for example, the invention provides for the correlation of the display visible in each case with a specific position of the hands. In this embodiment, displays are possible which take on particular significance when visible at a specific point in time or over a specific period of time.

In a first preferred exemplary embodiment of the invention, the display element is designed as a disc which can be continuously rotated via a drive or can be discretely stepped forward.

Use of the driven disc, on which the depictions of the Chinese life symbols are arranged, makes for a simple design. The Chinese life symbols are in this case easy to recognize in their pictorial representation in the form of an animal head, thus avoiding confusion of the life symbols with one another. It is of course also possible to represent the symbols in written form.

In order to display the depictions clearly in this example, the disc is expediently arranged under a dial and an aperture is provided in the dial, through which the individual depictions become visible one after the other as the disc rotates. Not all the depictions are therefore visible at one time, but only the depiction of one Chinese life symbol, ensuring a clear display.

This embodiment also provides for the disc to have a cycle time of 24 hours for one rotation. The depictions of the Chinese symbols can therefore be recurrently repeated after one day.

To make for a compact arrangement, the disc advantageously has a central recess within which the drive is arranged. By means of the drive, both the disc and the hour hand or an additional minute or second hand or for example a moon phase or date indicator can be driven.

For quick recognition, pictorial sketches of the Chinese life symbols are advantageously arranged on the disc. The pictorial symbol of a dragon is for example displayed between 7 a.m. and 9 a.m.

The pictorial symbol may be engraved in the disc or painted on the disc. Coloured representations of the life symbols are also conceivable.

A further disc with years on it can in addition be provided, the visible depiction of one of the twelve Chinese life symbols in each case correlating with a specific year. A further disc with the life symbols could also be arranged alongside the disc with years, displaying the corresponding symbol for the given year.

In a second embodiment of the invention, the display element according to the invention integrated in an analogue wristwatch is designed as a retrograde display pointing to the twelve life symbols in written form on a visible curved ring, with which a hand is associated which correlates with the hour hand, minute hand or second hand of the time display and/or with the moon phase or date indicator and points in each case for two hours to one of the twelve signs.

BRIEF DESCRIPTION OF THE DRAWINGS

The invention is explained in more detail below with reference to the drawing. The drawing essentially illustrates the two exemplary embodiments of the invention described above. In the drawing.

DESCRIPTION OF THE PREFERRED EMBODIMENTS

Figure 1:
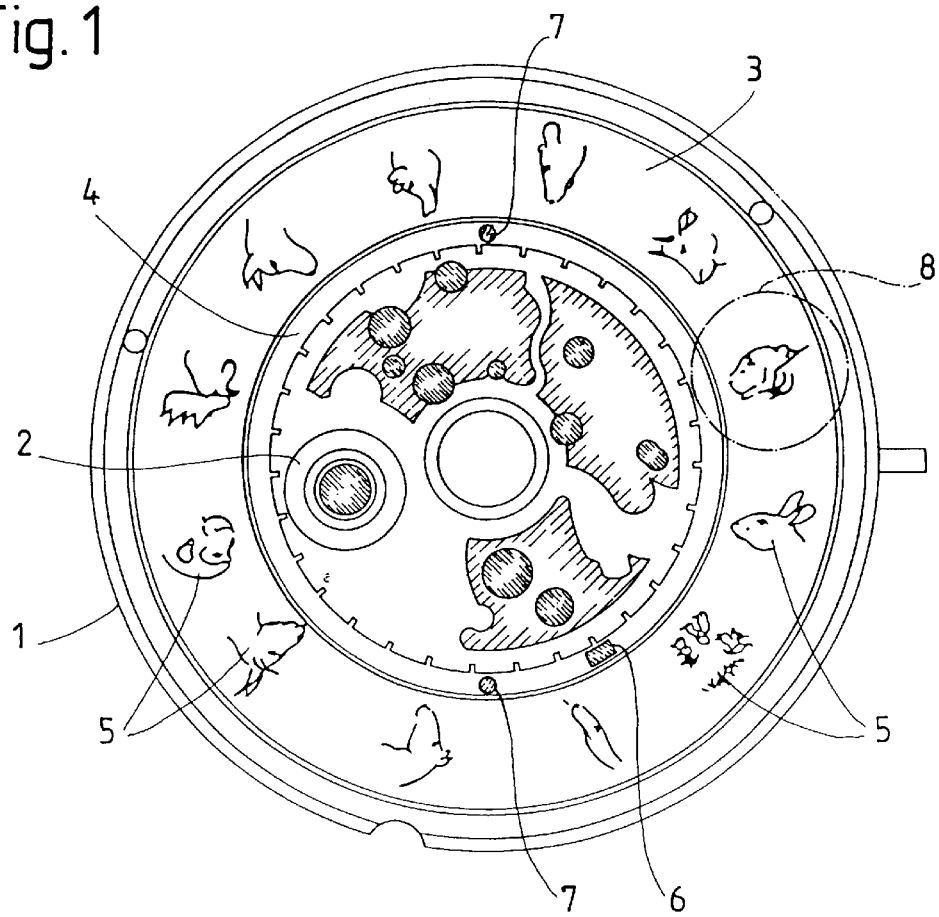
FIG. 1 is a plan view of a watch having a display element in accordance with the first exemplary embodiment.

The device according to the invention as illustrated in FIG. 1 is a watch having a circular case 1. A mechanism is arranged within the case 1, having a drive 2 for a disc 3. The disc 3 is located between the case 1 and the mechanism 2 and has a central recess 4 into which the mechanism 2 projects. Twelve pictorial representations 5 are arranged on the disc 3, each representation showing a sketch of the profile of an animal's head and corresponding to a Chinese life symbol. The twelve representations are the rat, ox, tiger, rabbit, dragon, snake, horse, ram, monkey, rooster, dog and pig. The watch also has a hand 6 arranged within the disc 3 and hour markings 7. The hand 6 and the hour markings 7 are only represented diagrammatically in the drawing. The disc 3 is covered on its upper face by a dial (not shown in the drawing), this dial having an aperture 8 (diagrammatically represented in the drawing), in which the individual depictions 5 become visible. The gearwheels of the mechanism 2 are designed such that the disc 3 has a cycle time of 24 hours for one rotation. The disc 3 therefore executes one full rotation over one day. The disc 3 is furthermore driven via the mechanism 2 such that one depiction 5 is in each case always visible for two full hours over a quite specific period in the aperture 8. The mechanism is designed such that the symbol of a rat is displayed from 11 p.m. to 1 a.m. Then the symbol of an ox is displayed from 1 a.m. to 3 a.m., the symbol of a tiger from 3 a.m. to 5 a.m., the symbol of a rabbit from 5 a.m. to 7 a.m., the symbol of a dragon from 7 a.m. to 9 a.m., the symbol of a snake from 9 a.m. to 11 a.m., the symbol of a horse from 11 a.m. to 1 p.m., the symbol of a ram from 1 p.m. to 3 p.m., the symbol of a monkey from 3 p.m. to 5 p.m., the symbol of a rooster from 5 p.m. to 7 p.m., the symbol of a dog from 7 p.m. to 9 p.m. and the symbol of a pig from 9 p.m. to 11 P.M.

With the device according to the invention, in each case one of the twelve Chinese life symbols can be displayed for a period of two hours in simple to recognize fashion, clearly and for specific full hours.

Figure 2:
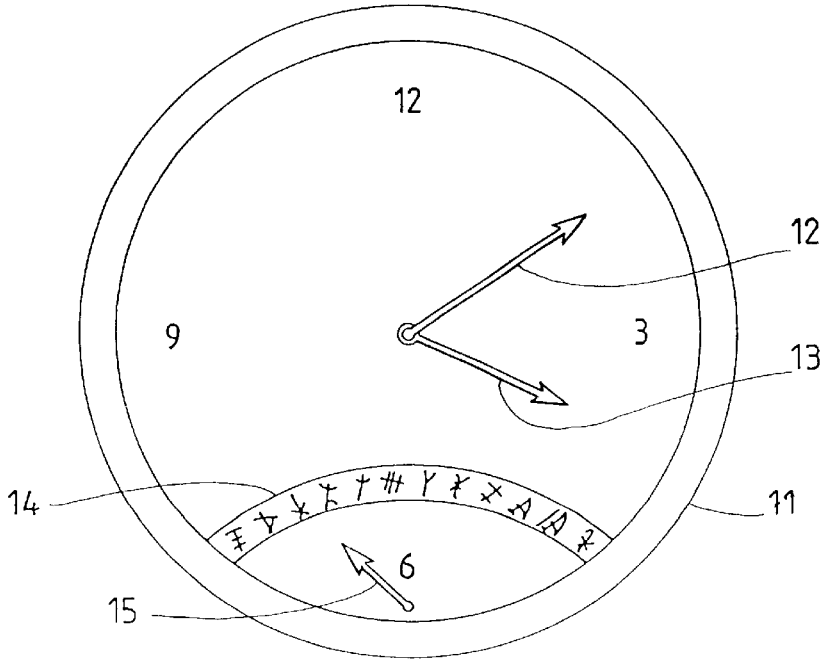
FIG. 2 is a plan view of a watch having a display element in accordance with the second exemplary embodiment.

The device shown in FIG. 2 is also a watch having a circular case 11, within which a mechanism is arranged which serves for analogue display and controls two hands 12 and 13.

The display element is in this case designed as a retrograde display and points to the twelve life symbols on a curved ring segment 14 arranged visibly in the display field of the watch. This display also has a hand 15, correlating with the hour hand 13 and/or the minute hand 12 of the time display.

The twelve symbols are diagrammatic representations of the characters for the rat, ox, tiger, rabbit, dragon, snake, horse, ram, monkey, rooster, dog and pig.

The hand 15 executes one full swing from left to right over one day. Furthermore, the hand 15 is driven via the mechanism such that it points in each case for two full hours to one of the twelve symbols and at the end of the last two-hour segment of the day swings to the left and begins the display cycle from the start for the next day.

Figure 3:
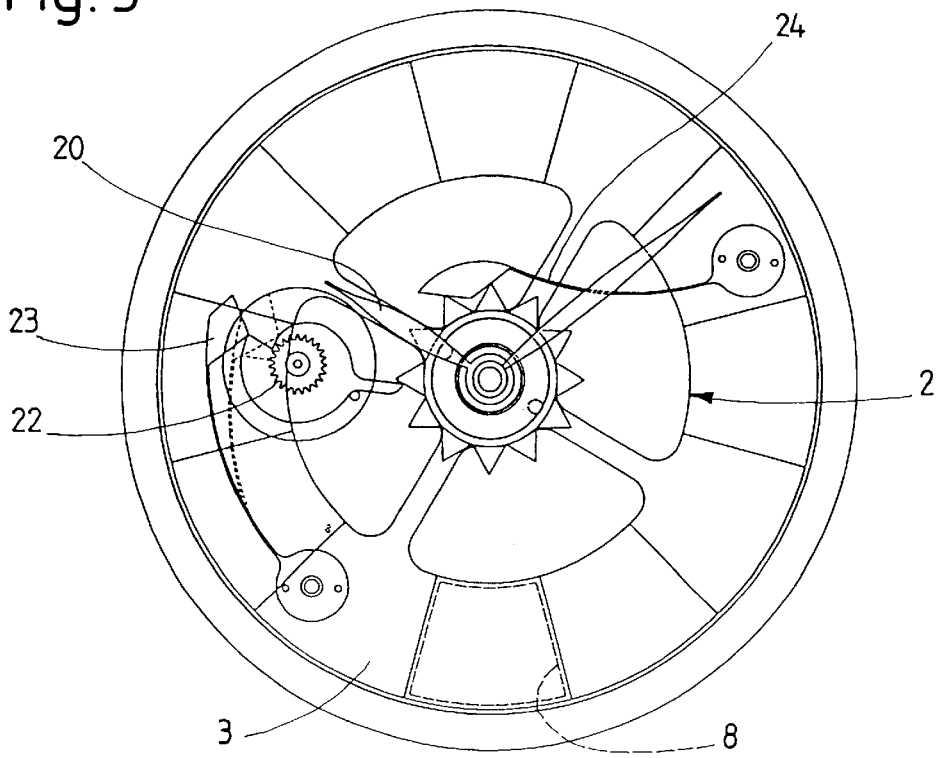
FIGS. 3 and 4 show the gear layout of the mechanism, as provided for according to the invention in the first exemplary embodiment.
Figure 4:
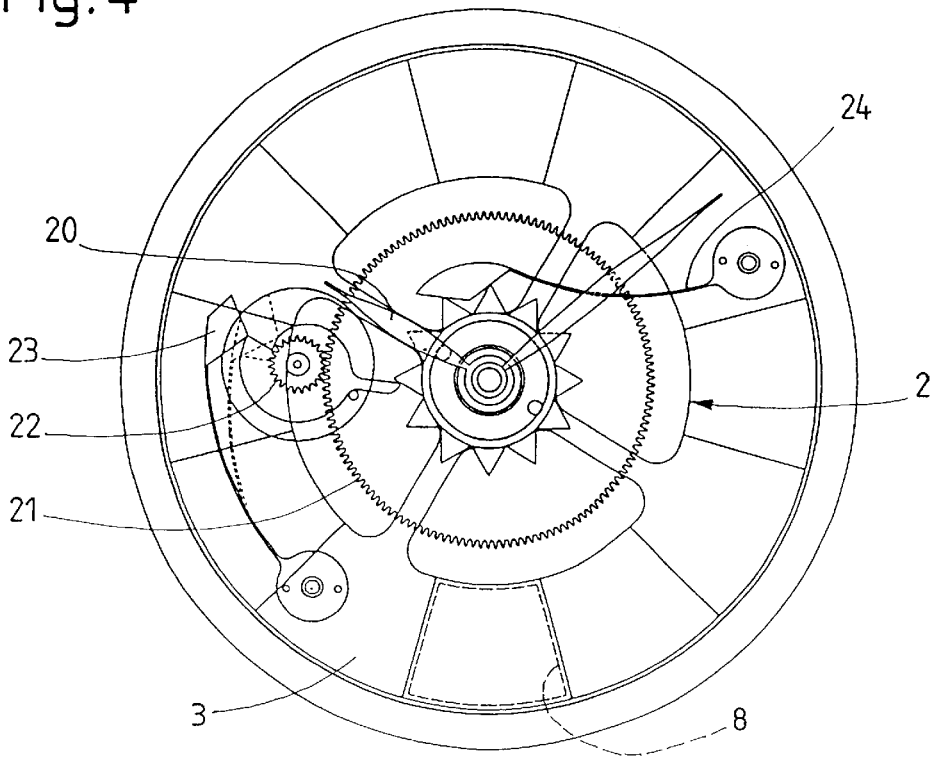

FIGS. 3 and 4 illustrate the gearwheel lay-out as employed according to the invention in the first exemplary embodiment, the aperture 8 of the dial (not shown) being provided in these figures at the "6 o'clock" position.

As these figures show, the mechanism 2 is provided with two gearwheels rotationally coupled to one another, namely a central gearwheel 21 assigned to the hour hand 20 and a decentrally mounted gearwheel 22. The latter gearwheel is designed and coupled to the gearwheel 21 in such a way that it executes twelve rotations every 24 hours, i.e. one rotation for every two-hour segment or for every symbol to be displayed. Contrarily, the gearwheel 21 is designed and coupled to the mechanism 2 such that it executes two revolutions every 24 hours. The disc 3 is now driven via the mechanism 2, or the gearwheels 21 and 22, such that it executes one full rotation over one day. The springs 23 and 24 also serve to ensure that the rotation of the disc 3 is not performed continuously, but quasi-continuously in twelve part-steps, so that the symbols remain completely visible in the aperture 8 for the two-hours segments assigned to them and are replaced at the two-hour change by the next symbol by means of a 30° rotation of the disc 3.

It should be pointed out in conclusion that the devices described with reference to FIGS. 1 to 4 for displaying signs and symbols only constitute a selection from a number of possible embodiments of the invention and can be modified in different respects.

Thus, in the embodiment having a rotatable annular disc, the latter can also be arranged on the dial or constitute a part thereof, for example the central part thereof, i.e. be completely visible. In this case, the disc having a cycle of 24 hours/per rotation correlates with a hand, for example the hour hand, in such a way that a marking pointer positionally fixed on the dial points in each case for two hours to the life symbol assigned to the corresponding time.

Furthermore, the display element according to the invention can of course also be formed by a digital liquid-crystal display and depict the twelve symbols mentioned above pictorially or as characters in intervals of two hours. A display element of this kind may then optionally be integrated in a wristwatch having a digital or analogue time display. Similarly, the retrograde display, as described with reference to FIG. 2, may naturally also be integrated in a watch having a digital liquid-crystal time display and/or depict the twelve life symbols in pictorial form.

What is claim is:

1. Watch having a digital or analogue time display and a device for displaying Chinese depictions by means of a display element, characterized in that the display element is designed to represent the twelve Chinese life symbols and in each case visually reveals or marks out one life symbol for a time period of two hours in the display field of the watch, the respectively visible or marked depiction (5) correlating with a specific time display.

2. Device according to claim 1, characterized in that each life symbol is represented pictorially in the form of an animal head or as a character symbol.

3. Device according to claim 1 characterized in that the display element has a disc (3) which can be continuously rotated via a drive or can be discretely stepped forward, the Chinese depictions being arranged around the said disc.

4. Device according to claim 3, characterized in that the disc (3) is arranged under a dial having an aperture (8) in which the individual depictions (5) are visible one after the other.

5. Device according to claim 3, characterized in that the rotatable, annular disc is arranged on a dial or constitutes a part thereof.

6. Device according to claim 3, characterized in that the cycle time for one rotation of the disc (3) is 24 hours.

7. Device according to claim 3, characterized in that the disc (3) has a central recess (4) within which the drive (2) is arranged.

8. Device according to claim 3, characterized in that a further disc is provided with years on it, the visible depiction of the Chinese symbols in each case correlating with a specific year on the second disc.

9. Device according to claim 1, characterized in that the display element is designed as a retrograde display having a curved annular segment (14), on which the life symbols are arranged alongside one other, and in that a hand (15) is provided which correlates with the time display and points in each case for two hours to one of the twelve symbols.

10. Device according to claim 1, characterized in that the display element is a digital liquid-crystal display.

* * * * *